US010040621B2

(12) United States Patent
Duffy et al.

(10) Patent No.: US 10,040,621 B2
(45) Date of Patent: Aug. 7, 2018

(54) FILTERING FACE-PIECE RESPIRATOR DISPENSER

(71) Applicant: 3M INNOVATIVE PROPERTIES COMPANY, St. Paul, MN (US)

(72) Inventors: Dean R. Duffy, Woodbury, MN (US); Robert E. Holler, Cottage Grove, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 655 days.

(21) Appl. No.: 14/220,594

(22) Filed: Mar. 20, 2014

(65) Prior Publication Data

US 2015/0266655 A1 Sep. 24, 2015

(51) Int. Cl.

| | |
|---|---|
| ***A47K 10/24*** | (2006.01) |
| ***B65H 1/00*** | (2006.01) |
| ***B65D 83/08*** | (2006.01) |
| ***A41D 13/11*** | (2006.01) |

(52) U.S. Cl.

CPC ..... *B65D 83/0805* (2013.01); *A41D 13/11* (2013.01); *Y10T 29/49826* (2015.01)

(58) Field of Classification Search

CPC ..... A41D 13/11; Y10T 29/49826; B65D 83/0805

USPC ..... 221/47; 206/438, 278

See application file for complete search history.

(56) References Cited

U.S. PATENT DOCUMENTS

| | | | | |
|---|---|---|---|---|
| 2,340,090 A * | 1/1944 | Vineburgh | B65D 83/00 | 221/307 |
| 2,804,236 A * | 8/1957 | Piazze | A47F 1/085 | 206/806 |
| 3,971,373 A | 7/1976 | Braun | | |
| 4,013,816 A | 3/1977 | Sabee | | |
| 4,215,682 A | 8/1980 | Kubik | | |
| 4,269,315 A * | 5/1981 | Boyce | B65D 83/0847 | 128/206.19 |
| RE31,285 E | 6/1983 | van Turnhout | | |
| 4,536,440 A | 8/1985 | Berg | | |
| 4,550,856 A * | 11/1985 | Ballmann | A41D 13/11 | 128/202.13 |

(Continued)

FOREIGN PATENT DOCUMENTS

| | | |
|---|---|---|
| EP | 1737316 | 1/2007 |
| WO | WO 1996-28216 | 9/1996 |
| WO | WO 2014/026037 | 2/2014 |

OTHER PUBLICATIONS

Davies, "The Separation of Airborne Dust and Particles", Institution of Mechanical Engineers, London, 1952, Proceedings 1B.

(Continued)

*Primary Examiner* — Rakesh Kumar

(57) ABSTRACT

A filtering face-piece respirator dispenser 10 having a container 14 that has a constriction aperture 20 and a plurality of filtering, face-piece respirators 12 disposed within the container 14 in a stacked, at least partially-folded arrangement. The stacked respirators 12 include an outermost respirator 12*a*. The constriction aperture 20 is adapted to allow for the outermost flat filtering face-piece respirator 12*a* to be manually withdrawn from the container 14 such that the outermost respirator 12*a* goes from the at least partially-folded condition to an open condition, making the respirator more ready for donning.

21 Claims, 4 Drawing Sheets

(56) References Cited

U.S. PATENT DOCUMENTS

| | | | | |
|---|---|---|---|---|
| 4,588,537 | A | 5/1986 | Klaase | |
| 4,673,084 | A * | 6/1987 | Hubbard | B65D 5/541 206/278 |
| 4,790,306 | A | 12/1988 | Braun | |
| 4,798,850 | A | 1/1989 | Brown | |
| 4,807,619 | A | 2/1989 | Dyrud | |
| 5,237,986 | A | 8/1993 | Seppala | |
| 5,322,061 | A * | 6/1994 | Brunson | 128/206.13 |
| 5,325,892 | A | 7/1994 | Japuntich | |
| 5,496,507 | A | 3/1996 | Angadjivand | |
| 5,558,089 | A | 9/1996 | Castiglione | |
| 5,615,767 | A | 4/1997 | Eull | |
| 5,656,368 | A | 8/1997 | Braun | |
| 5,804,295 | A | 9/1998 | Braun | |
| 5,908,598 | A | 6/1999 | Rousseau | |
| D412,573 | S | 8/1999 | Castiglione | |
| 6,041,782 | A | 3/2000 | Angadjivand | |
| 6,062,221 | A | 5/2000 | Brostrom | |
| 6,123,077 | A | 9/2000 | Bostock | |
| 6,234,171 | B1 | 5/2001 | Springett | |
| 6,267,262 | B1 * | 7/2001 | Wilner | B65D 83/0805 221/45 |
| D449,377 | S | 10/2001 | Henderson | |
| 6,332,465 | B1 | 12/2001 | Xue | |
| 6,375,886 | B1 | 4/2002 | Angadjivand | |
| 6,391,429 | B1 | 5/2002 | Senkus | |
| 6,394,090 | B1 | 5/2002 | Chen | |
| D459,471 | S | 6/2002 | Curran | |
| 6,397,458 | B1 | 6/2002 | Jones | |
| 6,398,847 | B1 | 6/2002 | Jones | |
| 6,406,657 | B1 | 6/2002 | Eitzman | |
| 6,409,806 | B1 | 6/2002 | Jones | |
| 6,454,986 | B1 | 9/2002 | Eitzman | |
| 6,484,722 | B2 | 11/2002 | Bostock | |
| 6,492,286 | B1 | 12/2002 | Berrigan | |
| RE37,974 | E | 2/2003 | Bowers | |
| 6,568,392 | B1 | 5/2003 | Bostock | |
| 6,715,489 | B2 | 4/2004 | Bostock | |
| 6,722,366 | B2 | 4/2004 | Bostock | |
| 6,743,464 | B1 | 6/2004 | Insley | |
| 6,763,970 | B2 * | 7/2004 | Harris et al. | 221/33 |
| 6,783,574 | B1 | 8/2004 | Angadjivand | |
| 6,824,718 | B2 | 11/2004 | Eitzman | |
| 6,843,248 | B2 | 1/2005 | Japuntich | |
| 6,854,463 | B2 | 2/2005 | Japuntich | |
| 6,868,984 | B2 * | 3/2005 | Griesbach, III | A41D 13/11 221/303 |
| 6,883,518 | B2 | 4/2005 | Mittelstadt | |
| 6,886,563 | B2 | 5/2005 | Bostock | |
| 6,923,182 | B2 | 8/2005 | Angadjivand | |
| 7,013,895 | B2 | 3/2006 | Martin | |
| 7,028,689 | B2 | 4/2006 | Martin | |
| 7,117,868 | B1 | 10/2006 | Japuntich | |
| 7,131,442 | B1 | 11/2006 | Kronzer | |
| RE39,493 | E | 2/2007 | Yuschak | |
| 7,188,622 | B2 | 3/2007 | Martin | |
| 7,311,104 | B2 | 12/2007 | Japuntich | |
| 7,428,903 | B1 | 9/2008 | Japuntich | |
| D620,104 | S | 7/2010 | Curran | |
| D637,711 | S | 5/2011 | Facer | |
| 8,066,006 | B2 | 11/2011 | Daugaard | |
| D657,050 | S | 4/2012 | Henderson | |
| 8,146,594 | B2 | 4/2012 | Bostock | |
| D659,821 | S | 5/2012 | Spoo | |
| D667,541 | S | 9/2012 | Spoo | |
| 8,375,950 | B2 | 2/2013 | Bostock | |
| 8,528,560 | B2 | 9/2013 | Duffy | |
| 2004/0056043 | A1 | 3/2004 | Griesbach | |
| 2004/0099677 | A1 | 5/2004 | Harris | |
| 2007/0044803 | A1 | 3/2007 | Xue | |
| 2007/0068529 | A1 | 3/2007 | Kalatoor | |
| 2007/0210096 | A1 | 9/2007 | Ellswood | |
| 2008/0271737 | A1 | 11/2008 | Facer | |
| 2008/0271739 | A1 | 11/2008 | Facer | |
| 2008/0271740 | A1 | 11/2008 | Gloag | |
| 2010/0154805 | A1 | 6/2010 | Duffy | |
| 2011/0067700 | A1 | 3/2011 | Spoo | |

OTHER PUBLICATIONS

Wente, "Superfine Thermoplastic Fibers", Industrial and Engineering Chemistry, 1956, vol. 48, No. 8, pp. 1342-1346.

U.S. Appl. No. 13/727,923 to Duffy entitled *Filtering Face-Piece Respirator Having Folded Flange*.

U.S. Appl. No. 14/013,214 to Duffy entitled *Filtering Face-Piece Respirator with Stiffening Member Integral with Filtering Structure*.

U.S. Appl. No. 14/013,314 to Duffy entitled Filtering *Face-Piece Respirator Having Darted Mask Body*.

International Application PCT/US2015/020854 Search Report dated May 22, 2015.

* cited by examiner

FILTERING FACE-PIECE RESPIRATOR DISPENSER

The present invention pertains to a filtering face-piece respirator dispenser that causes, during the dispensing process, a respirator to go from a folded or partially-folded condition to an open condition.

BACKGROUND

Respirators are commonly worn over a person's breathing passages for at least one of two common purposes: (1) to prevent impurities or contaminants from entering the wearer's respiratory system; and (2) to protect other persons or things from being exposed to pathogens and other contaminants exhaled by the wearer. In the first situation, the respirator is worn in an environment where the air contains particles that are harmful to the wearer, for example, in an auto body shop. In the second situation, the respirator is worn in an environment where there is risk of contamination to other persons or things, for example, in an operating room or clean room.

A variety of respirators have been designed to meet either (or both) of these purposes. Some respirators have been categorized as being "filtering face-pieces" because the mask body itself functions as the filtering mechanism. Unlike respirators that use rubber or elastomeric mask bodies in conjunction with attachable filter cartridges (see, e.g., U.S. Pat. RE39,493 to Yuschak et al.) or insert-molded filter elements (see, e.g., U.S. Pat. No. 4,790,306 to Braun), filtering face-piece respirators are designed to have the filter media cover much of the whole mask body so that there is no need for installing or replacing a filter cartridge. These filtering face-piece respirators commonly come in one of two configurations: molded respirators and flat-fold respirators.

Molded, filtering face piece respirators have regularly comprised non-woven webs of thermally-bonding fibers or open-work plastic meshes to furnish the mask body with its cup-shaped configuration. Molded respirators tend to maintain the same shape during both use and storage. These respirators therefore cannot be folded flat for storage and shipping. Examples of patents that disclose molded, filtering face-piece respirators include U.S. Pat. No. 7,131,442 to Kronzer et al, U.S. Pat. Nos. 6,923,182, 6,041,782 to Angadjivand et al.,U.S. Pat. No. 4,807,619 to Dyrud et al., and U.S. Pat. No. 4,536,440 to Berg.

Flat-fold respirators —as their name implies —can be folded flat for shipping and storage. They also can be opened into a cup-shaped configuration for use. Flat fold respirators commonly derive their structural integrity not from being molded but rather from being provided with a series of weld, seam and/or fold lines that impart that integrity to the mask body when it is placed in an unfolded condition. Stiffening members also have been incorporated into panels of the mask body. Examples of flat-fold respirators are shown in U.S. Pat. Nos. 6,568,392 and 6,484,722 to Bostock et al., and 6,394,090 to Chen —see also, U.S. Patent Applications 2010/0067700 and 2010/0154805 to Duffy et al., and U.S. Design Pat. No 659,821 to Spoo et al.

Non-molded respirators also have been designed which approximate the structure of a molded mask body. These products may not fold completely flat when placed in the storage condition. As such they present good candidates for storage in a stacked or nested arrangement. Examples of these kinds of respirators are shown in the following U.S. patent applications: Ser. Nos. 13/727,923, 14/013,214, 14/013,314 to Duffy.

Molded and flat fold respirators are commonly furnished to the end user in a box that has a reclosable top or an access partition perforated into one of the side panels of the box. When the access partition is removed, by severing it along the perforated line, the end user can reach into the box to retrieved one or more of the respirators located within it. The respirators are regularly stacked one-upon-the-other within the box, typically in a nested arrangement for space saving purposes. Unlike flat fold respirators, molded products often are not individually wrapped, and they are provided to the end user in an in-use condition. Users do not need to remove the wrapper or open the product from a folded condition to make it ready to don. Molded respirators, therefore, are provided in a ready-to-use configuration. Historically, non-molded respirators have not possessed this advantage: the end user has needed to learn how to adapt the mask body into its in-use configuration. The present invention accordingly addresses a way to deliver non-molded respirators to the end user in a manner that allows for intuitive donning of the respirator direct from the storage container.

SUMMARY OF THE INVENTION

The present invention provides a filtering face-piece respirator dispenser that comprises:

(a) a container that has a constriction aperture; and (b) a plurality of filtering, face-piece respirators disposed within the container in a stacked, at least partially-folded arrangement, the plurality of at least partially-folded, filtering, face-piece respirators including an outermost respirator;

wherein the constriction aperture is sized to allow for the outermost filtering face-piece respirator to be manually withdrawn from the container such that the outermost respirator goes from the at least partially-folded condition to an open condition.

The present invention is beneficial in that it allows non-molded respirators to be furnished to the wearer in an open condition. The wearer may, once the respirator is withdrawn from the container, place the device on his or her face with little-to-no further manipulation of the mask body. The invention accordingly provides partially folded, or folded, respirators with an intuitive shape for proper donning once removed from the dispenser. In contrast, conventional respirator containers require the end user to manually open the folded mask body after removing it from the box. The end user also has to commonly unwrap the folded respirator from its individual packaging. The present invention enables folded respirators to be removed from the container and to be placed in an essentially in-use condition in one step. Using the present invention, a nose clip (if one is present on the mask body) also can be bent into a concave shape when the mask body is withdrawn from the container. The concave bend further highlights proper respirator shape and orientation to the end user for ease of donning. This inventive dispensing concept accordingly offers increased user convenience and may enhance non-molded respirator acceptance by respirator wearers.

GLOSSARY

The terms set forth below will have the meanings as defined:

"at least partially-folded" means that the respirator is not in a fully open condition;

"comprises" or "comprising" means its definition as is standard in patent terminology, being an open-ended term that is generally synonymous with "includes", "having", or "containing" Although "comprises", "includes", "having", and "containing" and variations thereof are commonly-used, open-ended terms, this invention also may be suitably described using narrower terms such as "consists essentially of", which is semi open-ended term in that it excludes only those things or elements that would have a deleterious effect on the performance of the inventive respirator in serving its intended function;

"clean air" means a volume of atmospheric ambient air that has been filtered to remove contaminants;

"constriction aperture" means an opening (or an intended opening) which is sized to provide interference with products that are pulled through the opening;

"contaminants" means particles (including dusts, mists, and fumes) and/or other substances that generally may not be considered to be particles (e.g., organic vapors, etc.) but which may be suspended in air;

"container" means a device or combination of parts that has a chamber that can enclose or hold, within certain limits, other products or things;

"crosswise dimension" is the dimension that extends laterally across the respirator, from end-to-end when the respirator is viewed from the front in its at least partially folded condition;

"cup-shaped configuration", and variations thereof, mean any vessel-type shape that is capable of adequately covering the nose and mouth of a person;

"dispenser" means a device that allows the items disposed within it to be taken out and used by a person;

"disposed within" means all or most of the items are fully or at least partially located within the container;

"exterior gas space" means the ambient atmospheric gas space into which exhaled gas enters after passing through and beyond the mask body and/or exhalation valve;

"exterior surface" means the surface of the mask body exposed to ambient atmospheric gas space when the mask body is positioned on the person's face;

"few" means six or more;

"filtering face-piece" means that the mask body itself is designed to filter air that passes through it; there are no separately identifiable filter cartridges or insert-molded filter elements attached to or molded into the mask body to achieve this purpose;

"filter" or "filtration layer" means one or more layers of air-permeable material, which layer(s) is adapted for the primary purpose of removing contaminants (such as particles) from an air stream that passes through it;

"filter media" means an air-permeable structure that is designed to remove contaminants from air that passes through it;

"filtering structure" means a generally air-permeable construction that includes filter media;

"fully open condition" means that the mask body is molded or otherwise placed into a cup-shaped configuration ready for placement on a wearer's face;

"harness" means a structure or combination of parts that assists in supporting a mask body on a wearer's face;

"integral" means being made together as one part and not two separately manufactured parts that are subsequently joined together;

"interior gas space" means the space between a mask body and a person's face;

"interior surface" means the surface of the mask body closest to a person's face when the mask body is positioned on the person's face;

"line of demarcation" means a fold, seam, weld line, bond line, stitch line, hinge line, and/or any combination thereof;

"mask body" means an air-permeable structure that is designed to fit over the nose and mouth of a person and that helps define an interior gas space separated from an exterior gas space (including the seams and bonds that join layers and parts thereof together);

"molded" means being placed into an intended three-dimensional configuration through application of heat and pressure; the pressure being applied from male and female mold parts;

"multiple" means ten or more;

"near side hem" means a segment of the mask body perimeter of the outermost respirator which is nearest to the constriction aperture;

"nested" or "nesting" means stacked such that one product resides at least partially within another;

"non-molded" means that the mask body does not have a filtration layer supported by a molded, cup-shaped shaping layer;

"nose clip" means a mechanical device (other than a nose foam), which device is adapted for use on a mask body to improve a seal around a wearer's nose;

"nose region" means the portion that resides over a person's nose when the respirator is worn;

"open condition" means the mask body has had a projected surface area increase of at least 25% when tested under the Mask Body Open Condition Test set forth below;

"outermost" means the respirator which is positioned adjacent to the constriction aperture to be the next one removed from the container;

"perimeter" means the outer edge of the mask body, which outer edge would be disposed generally proximate to a wearer's face when the respirator is being donned by a person;

"perimeter segment" means a portion of the perimeter;

"pleat" means a portion that is designed to be or is folded back upon itself;

"polymer" means a material that contains repeating chemical units, regularly or irregularly arranged;

"polymeric" and "plastic" each mean a material that mainly includes one or more polymers and that may contain other ingredients as well;

"plurality" means two or more;

"pre-bend" in reference to the nose clip means that the nose clip has a bend placed in it that places the nose clip closer to its in-use shape;

"respirator" means an air filtration device that is worn by a person to provide the wearer with clean air to breathe;

"stacked" means an orderly pile of products;

"transversely extending" means extending generally in the crosswise dimension; and "wearable condition" means the mask body has a shape that makes the respirator ready for donning or nearly so.

DETAILED DESCRIPTION OF PREFERRED EMBODIMENTS

In practicing the present invention, a dispenser is provided that allows a respirator to be removed therefrom in a quick and easy manner and in an intuitive-to-don shape ready for placement on the wearer's face. When a nose clip is desired to be used on the respirator, the nose clip also can be furnished to the wearer in a pre-bent condition also ready for use. The ready-to-use respirator shape and nose clip pre-bend can both be achieved during the act of removing the respirator from the dispenser.

Figure 1A:
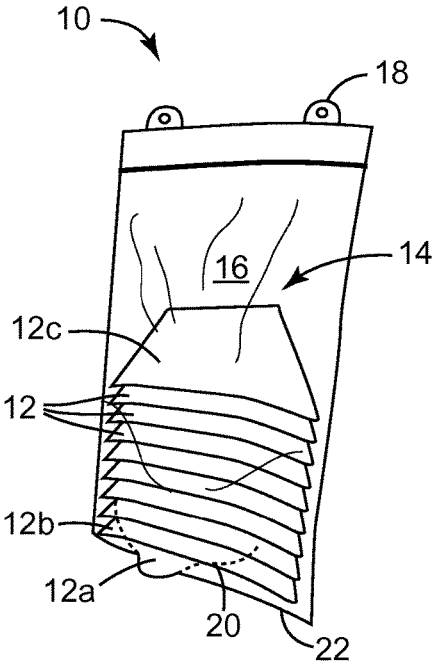
FIG. 1A is a front perspective view of a dispenser 10 that has flat-fold filtering face-piece respirators 12 being stored within the container 14 in a stacked condition in accordance with the present invention.

FIG. 1A shows an example of a respirator dispenser 10 that has a plurality of filtering, face-piece respirators 12 disposed within a container 14 in a stacked, at least partially-folded arrangement. Each individual respirator 12 is not individually wrapped in a distinct plastic package. The partially-folded, filtering, face-piece respirators 12 include an outermost respirator 12*a* that is nested within the respirator 12*b* located immediately above it. Each of the respirators 12, with the exception of the topmost respirator 12*c*, is nested within the respirator located above it. The illustrated container 14 holds nine respirators within it. There may be one, a plurality, a few, or multiple of respirators within the container, for example, at least 6, 15, 20, or 25. The container 14 includes two or more panels 16 joined together at the edges. The front panel 16 may be transparent on at least on a portion of the panel to enable persons viewing the container 14 to examine how many respirators 12 remain within the container 14. The panels also may be flexible to minimize shipping and storage damage. One or more support members 18 may be attached to the container 14 to enable the dispenser 10 to be supported from another object such as a flat surface or wall. A constriction aperture 20 is located centrally on the front panel 16 near the bottom 22 of the container 14. The constriction aperture 20 is adapted to allow for the outermost filtering face-piece respirator 12*a* to be manually withdrawn from the container 14 such that the outermost respirator 12*a* goes from a partially-folded condition to an open condition.

Figure 1B:
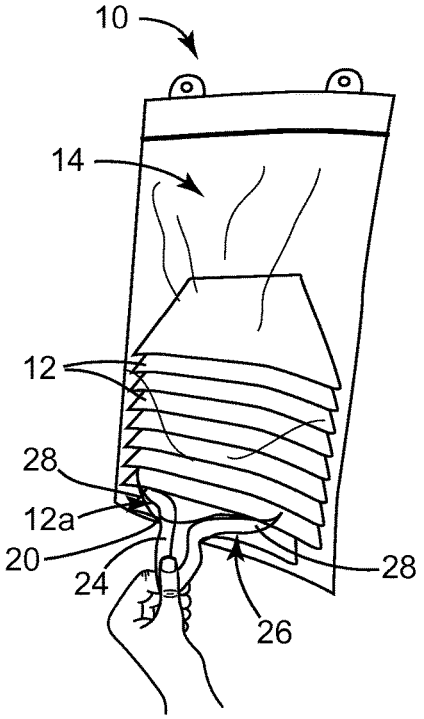
FIG. 1B is a front perspective view of a dispenser 10 where a person is removing the outermost respirator 12*a* from the container 14 in accordance with the present invention.

FIG. 1B shows how a person can remove the outermost respirator 12*a* from the container 14. Using their fingers, the person wanting to retrieve the respirator 12*a* from the dispenser 10 pinches or otherwise grasps the respirator 12*a* at its near side hem 24. With a generally downward motion, the person pulls on the near side hem 24 to place it in tension with the remainder of the respirator 12*a* still within the container. The constriction aperture 20 squeezes or constricts the respirator mask body 26 from its sides 28 as the respirator 10 is pulled through the aperture 20. The "constriction aperture" is physically sized to have a width that is less than the width of the folded or partially folded mask body in the cross-wise dimension. As the respirator 12*a* continues to be drawn through the constriction aperture 20, its partially folded condition is altered to an open condition. The mask body 26 preferably exhibits a projected surface area increase of at least 25%, more preferably at least 35%, and still more preferably at least 45%, and up to about 60%, when tested under the Mask Body Open Condition Test set forth below. The frictional action or forces between the constriction aperture 20 and the mask body 26 creates a "tugging action" between the top portion 30 (FIG. 1C) of the mask body 26 and its sides 28. These frictional forces cause the mask body 26 to reconfigure its shape when passing through the constriction aperture. The constriction aperture is adapted to allow for the outermost, filtering face-piece respirator 12*a* to change from the at least partially-folded condition to, for example, a wearable condition as the outermost respirator 12*a* passes through the constriction aperture 26.

Figure 1C:
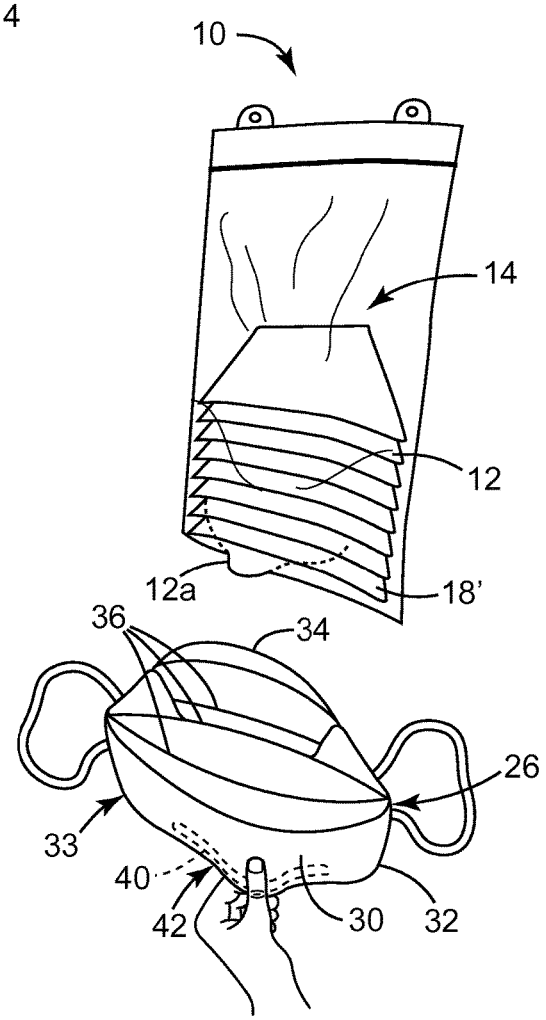
FIG. 1C is a front perspective view of a dispenser 10 where a person has removed the outermost respirator 12*a* from the container 14 in accordance with the present invention.

FIG. 1C shows how the tugging action, which occurs when a respirator is pulled through the aperture 20, separates a top segment 32 of the mask body perimeter 33 from the bottom segment 34. The pulling of the outermost respirator 12*a* though the constriction aperture 20 also causes one or more pleats 36 in the mask body 26 to separate or open. When the mask body 26 has a nose clip 40 attached to it, the pulling action on the mask body 26 also causes the nose clip 40 to bend in a concave fashion, that is, it bends in a direction that approximates its in-use shape. This bending action thus creates a pre-bend in the nose clip 40 at the nose region 42 of the mask body 26. The pre-bend may be such that the distance from the apex of the curve to its base is about 10 to 50 millimeters (mm), more typically about 20 to 30 mm (this is the nose clip height or NCH dimension shown in FIG. 5). The action of removing the outermost respirator 12*a* from the container 14 accordingly places the mask body 26 in a cup-shaped, open condition ready for placement on a person's face. In this configuration, the dispensed respirator 12 has a shape that is more intuitive to don.

Figure 1D:
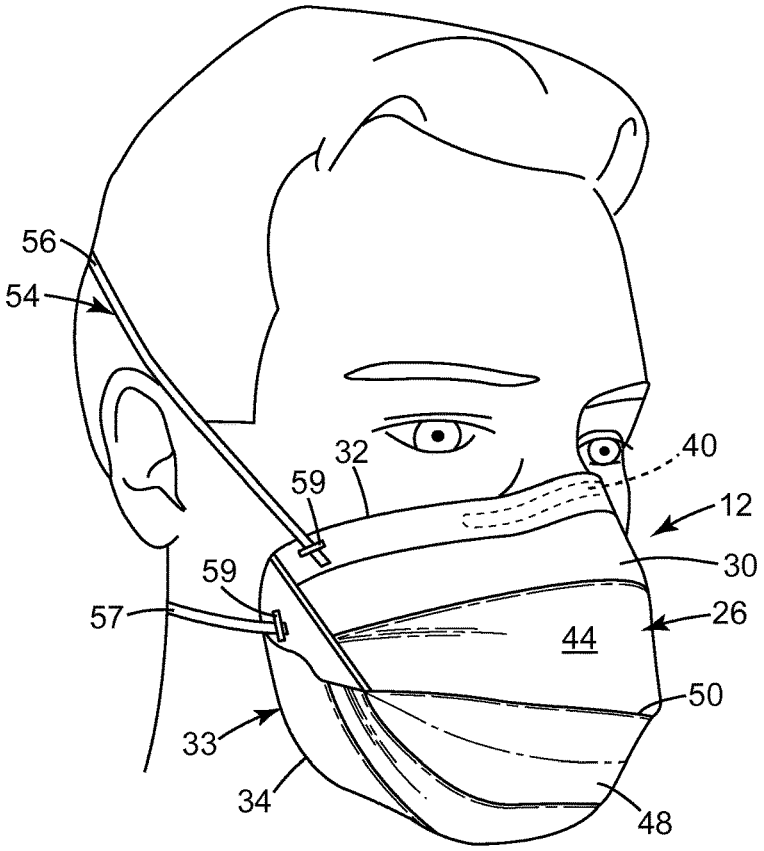
FIG. 1D is a perspective view of a person wearing a respirator 12 suitable for use in a dispenser 10 of the present invention.

FIG. 1D shows a filtering face piece respirator 12 being worn by a person over their nose and mouth. The mask body 26 has a filtering structure 44 through which inhaled air must pass before entering the wearer's respiratory system. The filtering structure 44 removes contaminants from the ambient environment so that the wearer breathes clean air. The filtering structure 44 is an integral part of the mask body 26, and it includes one or more layers of filter media to remove contaminants that pass through it. The shape and configuration of the filtering structure 44 corresponds to the general shape of the mask body 26. The mask body 26 includes a top portion 30 and a bottom portion 48 separated by a line of demarcation 50. In this particular embodiment, the line of demarcation 50 is a fold or pleat that extends transversely across the central portion of the mask body 26 from side-to-side. The mask body 26 also includes a perimeter 33 that includes a segment 32 at top portion 30 and a segment 34 at bottom portion 48. A harness 54 has a first, upper strap 56 that is secured to the top portion 30 of mask body 26 and a second, lower strap 57 that is secured to the bottom portion 48. The straps 56, 57 are secured to mask body 26 by staples 59 or by other means such as thermobonding or adhesive bonding. The mask body 26 also may have an exhalation valve secured to it to improve wearer comfort. Exhalation valves rapidly purge the warm, moist, exhaled air from the interior gas space. Further description of the filtering structure and the respirator componentry is set forth below. Examples of other foldable or partially foldable filtering face-piece respirators that may be used in connection with the present invention are shown or described in the following US patent publications: 8,375,950, 8,146,594, 6,886,563, 6,722,366, and 6,715,489 to Bostock et al, D620,104, D459,471, and D459,471 to Curran et al., U.S. Pat. No. 8,528,560 to Duffy, D667,541 and D659,821 to Spoo et al., D657,050 and D449,377 to Henderson et al., 2008/0271740 to Gloag et al., and 2008/0271737, 2008/0271739, and D637,711 to Facer et al.

Figure 2:
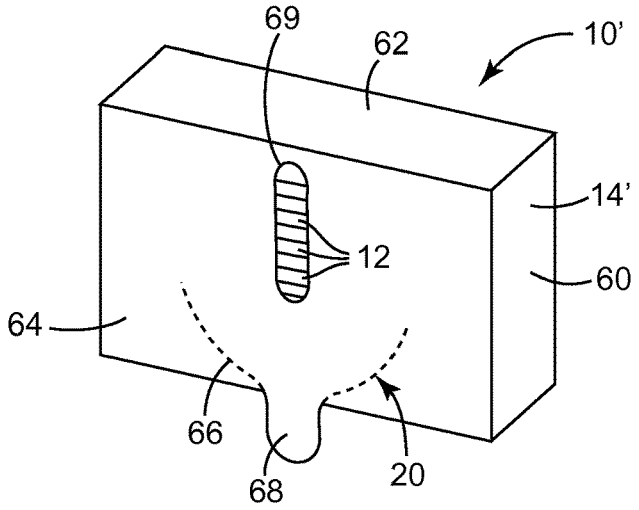
FIG. 2 is a perspective view of alternative embodiment of a dispenser 10' in accordance with the present invention.

FIG. 2 shows an alternative embodiment of a dispenser 10'. In this embodiment, the container 14' is a box 60 rather than a flexible package. The box 60 has two or more rectangular panels 62, 64. The front panel 64 has a constriction aperture 20 located therein. The aperture 20 is defined by a perforated line 66 in the front panel 64. A tab 68 can be associated with the aperture 20 to allow for the perforated line 66 to be easily broken. Once the perforated line 66 is severed, a person may have access to the respirators 12 disposed within the container 14'. The box-like container 14' may come in a variety of shapes and sizes to accommodate various shaped respirators and quantities. The box could be, for example, longer in the height dimension to increase the number of respirators per container. The box also could be cubical in shape, etc. A window 69 can be placed on the front panel 64 of the box 60 so that the quantity of respirators 12 remaining can be visually ascertained. The window 69 effectively functions as a respirator quantity gauge. The box 60 can be made from conventional materials such as corrugated cardboard, chipboard, plastic, metal, wood, etc. If desired, a motion activated dispensing apparatus may be included on the dispenser, which causes a respirator to be dispensed from the container mechanically with a hand motion beneath the sensor. The sensor desirably would be located at the base of the container, adjacent the constriction aperture 20.

Figure 3A:
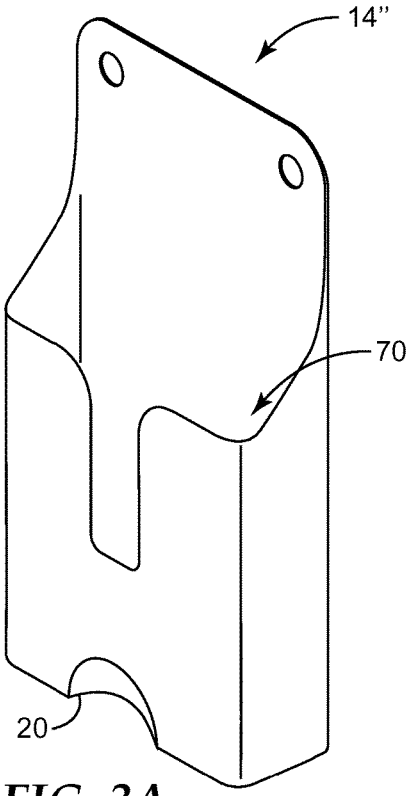
FIGS. 3A and 3B are perspective views of container embodiments 14" and 14''' in accordance with the present invention.
Figure 3B:
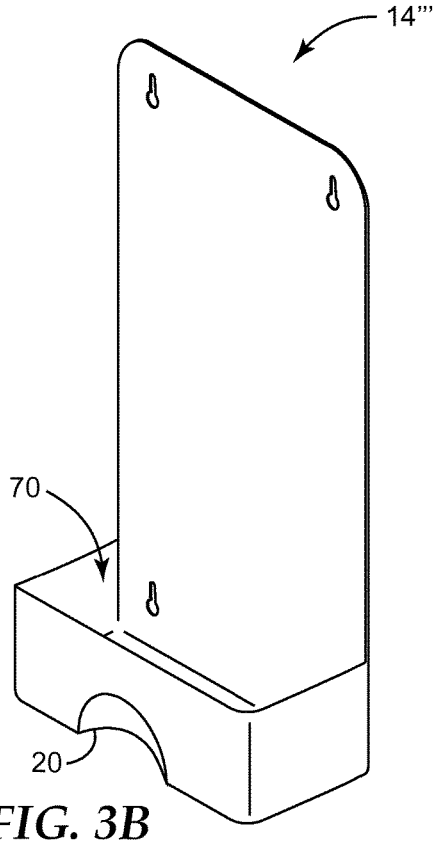

FIGS. 3A and 3B show alternative dispenser containers 14" and 14'" that can have a few or multiple of respirators placed in a receptacle or chamber 70. These containers 14" and 14'" are beneficial in that they can be reused many times. The containers 14" and 14'" are rigid in construction and can be made from injection-molded plastics, metals, wood, etc. The respirators that are used in conjunction with these containers may be placed within a further package or bag, which is then placed in the chamber 70. The package or bag into which the respirators are located would need to have an opening in the bottom, which allows the respirators to be drawn therethrough during the dispensing process. The bag opening would need to be sized to not interfere with the conversion of the respirator from its storage shape to its open condition. The constriction aperture 20 may be located on the dispenser receptacle 70 or it may be located on the bag into which the respirators are located. In the former instance, the receptacle 70 is considered to be the container, and in the latter instance, the bag is the container that contains the constriction aperture.

Figure 4:
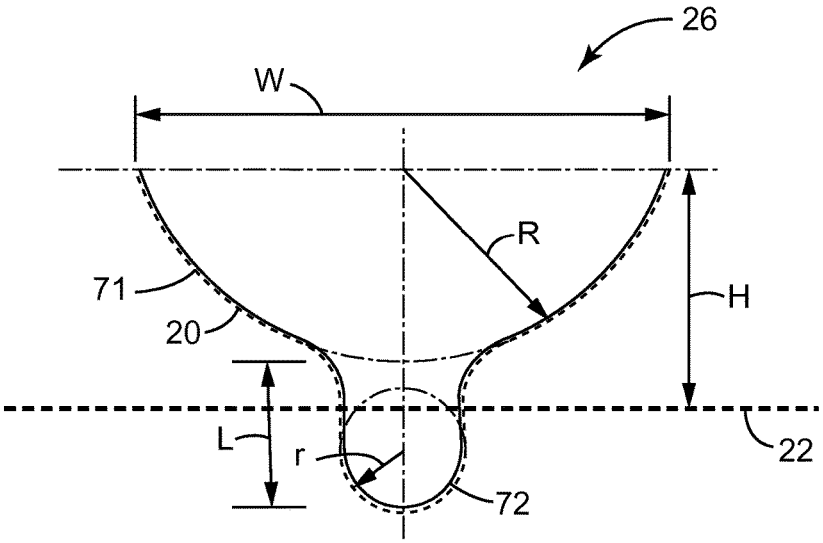
FIG. 4 is schematic view of a constriction aperture 20 in accordance with the present invention.

FIG. 4 shows an example of a constriction aperture 20 suitable for use in conjunction with the respirator shape shown and described above. In this embodiment, the aperture 20 is defined by a curved perforated line 71. The curved line may have a radius R of about 30 to 50 millimeters (mm), more typically 35 to 45 mm. A "pinch and peel" tab 72 may be provided to allow a person to quickly sever the perforated line 71 to make the aperture 20 useful for dispensing. The radius of curvature r of the tab end may be about 5 to 15 mm. The perforated line may extend upwardly a distance H of about 25 to 45 mm from the container base 22. The tab 72 may have a length L of about 10 to 25 mm. The constriction aperture may have other sizes and shapes as desired. The aperture may be elliptical, triangular, or rectangular. The width W of the constriction aperture 20 is less than the mask width MW (FIG. 5) of the respirator in its folded or partially folded condition. The width W of the constriction aperture typically is at least 40% less than, more typically 50% less than, the mask width MW of the mask body in its folded or partially folded condition.

Respirator Filtering Structure

The filtering structure that is used in connection with respirators suitable for use in connection with the present invention may take on a variety of different shapes and configurations. The filtering structure may have a plurality of layers, including a fibrous filtration layer and one or more fibrous cover webs —see, for example, U.S Patent Application entitled Filtering Face Piece Respirator Having Folded Flange, 13/727,923 to Duffy. Additionally, sorptive materials such as activated carbon may be disposed between the fibers and/or various layers that comprise the filtering structure. Further, separate particulate filtration layers may be used in conjunction with sorptive layers to provide filtration for both particulates and vapors. The filtering structure also may include one or more stiffening layers that assist in providing a cup-shaped configuration. The filtering structure may further have one or more horizontal and/or vertical lines of demarcation or folded flanges that contribute to the structural integrity of the mask body. The filtering structure that is used in a mask body of the invention can be of a particle capture or gas and vapor type filter. Filters that may be beneficially employed in a layered mask body of the invention are generally low in pressure drop (for example, less than about 195 to 295 Pascals at a face velocity of 13.8 centimeters per second) to minimize the breathing work of the mask wearer. Examples of particle capture filters include one or more webs of fine inorganic fibers (such as fiberglass) or polymeric synthetic fibers. Synthetic fiber webs may include electret-charged, polymeric microfibers that are produced from processes such as meltblowing. Polyolefin microfibers formed from polypropylene that has been electrically-charged provide particular utility for particulate capture applications. An alternate filter layer may comprise a sorbent component for removing hazardous or odorous gases from the breathing air. Sorbents may include powders or granules that are bound in a filter layer by adhesives, binders, or fibrous structures —see U.S. Pat. No 6,234,171 to Springett et al. and U.S. Pat. No. 3,971,373 to Braun. A sorbent layer can be formed by coating a substrate, such as fibrous or reticulated foam, to form a thin coherent layer. Sorbent materials may include activated carbons that are chemically treated or not, porous alumna-silica catalyst substrates, and alumna particles. An example of a sorptive filtration structure that may be conformed into various configurations is described in U.S. Patent No. 6,391,429 to Senkus et al.

The filtration layer is typically chosen to achieve a desired filtering effect. The filtration layer generally will remove a high percentage of particles and/or or other contaminants from the gaseous stream that passes through it. For fibrous filter layers, the fibers selected depend upon the kind of substance to be filtered and, typically, are chosen so that they do not become bonded together during the molding operation. As indicated, the filtration layer may come in a variety of shapes and forms and typically has a thickness of about 0.2 millimeters (mm) to 1 centimeter (cm), more typically about 0.3 mm to 0.5 cm, and it could be a generally planar web or it could be corrugated to provide an expanded surface area—see, for example, U.S. Pat. Nos. 5,804,295 and 5,656,368 to Braun et al. The filtration layer also may include multiple filtration layers joined together by an adhesive or any other means. Essentially any suitable material that is known (or later developed) for forming a filtering layer may be used as the filtering material. Webs of melt-blown fibers, such as those taught in Wente, Van A., *Superfine Thermoplastic Fibers*, 48 Indus. Engn. Chem., 1342 et seq. (1956), especially when in a persistent electrically charged (electret) form are especially useful (see, for example, U.S. Pat. No. 4,215,682 to Kubik et al.). These melt-blown fibers may be microfibers that have an effective fiber diameter less than about 20 micrometers (μm) (referred to as BMF for "blown microfiber"), typically about 1 to 12 μm. Effective fiber diameter may be determined according to Davies, C. N., *The Separation Of Airborne Dust Particles*, Institution Of Mechanical Engineers, London, Proceedings 1B, 1952. Particularly preferred are BMF webs that contain fibers formed from polypropylene, poly(4-methyl-1-pentene), and combinations thereof. Electrically charged fibrillated-film fibers as taught in van Turnhout, U.S. Pat. Re. 31,285, also may be suitable, as well as rosin-wool fibrous webs and webs of glass fibers or solution-blown, or electrostatically sprayed fibers, especially in microfilm form. Electric charge can be imparted to the fibers by contacting the fibers with water as disclosed in U.S. Pat. No. 6,824,718 to Eitzman et al., U.S. Pat. No. 6,783,574 to Angadjivand et al., U.S. Pat. No. 6,743,464 to Insley et al., U.S. Pat. Nos. 6,454,986 and 6,406,657 to Eitzman et al., and U.S. Pat. Nos. 6,375,886 and 5,496,507 to Angadjivand et al. Electric charge also may be imparted to the fibers by corona charging as disclosed in U.S. Pat. No. 4,588,537 to Klasse et al. or by tribocharging as disclosed in U.S. Pat. No. 4,798,850 to Brown. Also, additives can be included in the fibers to enhance the filtration performance of webs produced through the hydrocharging process (see U.S. Pat. No. 5,908,598 to Rousseau et al.). Fluorine atoms, in particular, can be disposed at the surface of the fibers in the filter layer to improve filtration performance in an oily mist environment—see U.S. Pat. Nos. 6,398,847 B1, 6,397,458 B1, and 6,409,806 B1 to Jones et al. Typical basis weights for electret BMF filtration layers are about 10 to 100 grams per square meter. When electrically charged according to techniques described in, for example, the '507 Angadjivand et al. patent, and when including fluorine atoms as mentioned in the Jones et al. patents, the basis weight may be about 20 to 40 g/m$^2$ or about 10 to 30 g/m$^2$.

An inner cover web can be used to provide a smooth surface for contacting the wearer's face, and an outer cover web can be used to entrap loose fibers in the mask body or for aesthetic reasons. The cover web typically does not provide any substantial filtering benefits to the filtering structure, although it can act as a pre-filter when disposed on the exterior (or upstream to) the filtration layer. To obtain a suitable degree of comfort, an inner cover web preferably has a comparatively low basis weight and is formed from comparatively fine fibers. More particularly, the cover web may be fashioned to have a basis weight of about 5 to 50 g/m$^2$ (typically 10 to 30 g/m$^2$), and the fibers may be less than 3.5 denier (typically less than 2 denier, and more typically less than 1 denier but greater than 0.1). Fibers used in the cover web often have an average fiber diameter of about 5 to 24 micrometers, typically of about 7 to 18 micrometers, and more typically of about 8 to 12 micrometers. The cover web material may have a degree of elasticity (typically, but not necessarily, 100 to 120% at break) and may be plastically deformable.

Suitable materials for the cover web may be blown microfiber (BMF) materials, particularly polyolefin BMF materials, for example polypropylene BMF materials (including polypropylene blends and also blends of polypropylene and polyethylene). A suitable process for producing BMF materials for a cover web is described in U.S. Pat. No. 4,013,816 to Sabee et al. The web may be formed by collecting the fibers on a smooth surface, typically a smooth-surfaced drum or a rotating collector—see U.S. Pat. No. 6,492,286 to Berrigan et al. Spun-bond fibers also may be used.

A typical cover web may be made from polypropylene or a polypropylene/polyolefin blend that contains 50 weight percent or more polypropylene. These materials have been found to offer high degrees of softness and comfort to the wearer and also, when the filter material is a polypropylene BMF material, to remain secured to the filter material without requiring an adhesive between the layers. Polyolefin materials that are suitable for use in a cover web may include, for example, a single polypropylene, blends of two polypropylenes, and blends of polypropylene and polyethylene, blends of polypropylene and poly(4-methyl-1-pentene), and/or blends of polypropylene and polybutylene. One example of a fiber for the cover web is a polypropylene BMF made from the polypropylene resin "Escorene 3505G" from Exxon Corporation, providing a basis weight of about 25 g/m$^2$ and having a fiber denier in the range 0.2 to 3.1 (with an average, measured over 100 fibers of about 0.8). Another suitable fiber is a polypropylene/polyethylene BMF (produced from a mixture comprising 85 percent of the resin "Escorene 3505G" and 15 percent of the ethylene/alpha-olefin copolymer "Exact 4023" also from Exxon Corporation) providing a basis weight of about 25 g/m$^2$ and having an average fiber denier of about 0.8. Suitable spunbond materials are available, under the trade designations "Corosoft Plus 20", "Corosoft Classic 20" and "Corovin PP-S-14", from Corovin GmbH of Peine, Germany, and a carded polypropylene/viscose material available, under the trade designation "370/15", from J. W. Suominen OY of Nakila, Finland.

Cover webs that are used in the invention preferably have very few fibers protruding from the web surface after processing and therefore have a smooth outer surface. Examples of cover webs that may be used in the present invention are disclosed, for example, in U.S. Pat. No. 6,041,782 to Angadjivand, U.S. Pat. No. 6,123,077 to Bostock et al., and WO 96/28216A to Bostock et al.

Respirator Componentry

The strap(s) that are used in the respirator harness may be made from a variety of materials, such as thermoset rubbers, thermoplastic elastomers, braided or knitted yarn/rubber combinations, inelastic braided components, and the like. The strap(s) may be made from an elastic material such as an elastic braided material. The strap preferably can be expanded to greater than twice its total length and can be returned to its relaxed state. The strap also could possibly be increased to three or four times its relaxed state length and can be returned to its original condition without any damage thereto when the tensile forces are removed. The elastic limit thus is preferably not less than two, three, or four times the relaxed-state length of the strap(s). Typically, the strap(s) are about 20 to 30 cm long, 3 to 10 mm wide, and about 0.9 to 1.5 mm thick. The strap(s) may extend from the first tab to the second tab as a continuous strap or the strap may have a plurality of parts, which can be joined together by further fasteners or buckles. For example, the strap may have first and second parts that are joined together by a fastener that can be quickly uncoupled by the wearer when removing the mask body from the face. Alternatively, the strap may form a loop that is placed around the wearer's ears—see e.g., U.S. Pat. No. 6,394,090 to Chen et al. An example of a strap that may be used in connection with the present invention is shown in U.S. Pat. No. 6,332,465 to Xue et al. Examples of fastening or clasping mechanism that may be used to joint one or more parts of the strap together is shown, for example, in the following U.S. Pat. No. 6,062,221 to Brostrom et al. and U.S. Pat. No. 5,237,986 to Seppala. The harness also may be in the form of a reusable carriage or an adhesive layer that is provided on the internal surface of the perimeter.

As indicated, an exhalation valve may be attached to the mask body to facilitate purging exhaled air from the interior gas space. The use of an exhalation valve may improve wearer comfort by rapidly removing the warm moist exhaled air from the mask interior. See, for example, U.S. Pat. Nos. 7,188,622, 7,028,689, and 7,013,895 to Martin et al.; U.S. Pat. Nos. 7,428,903, 7,311,104, 7,117,868, 6,854,463, 6,843,248, and 5,325,892 to Japuntich et al.; U.S. Pat. No. 6,883,518 to Mittelstadt et al.; and RE37,974 to Bowers. Essentially any exhalation valve that provides a suitable pressure drop and that can be properly secured to the mask body may be used in connection with the present invention to rapidly deliver exhaled air from the interior gas space to the exterior gas space.

A nose clip that is used in the present invention may be essentially any additional part that assists in improving the fit over the wearer's nose. Because the wearer's face exhibits a major change in contour in the nose region, a nose clip may be used to better assist in achieving the appropriate fit in this location. The nose clip may comprise, for example, a pliable dead soft band of metal such as aluminum, which can be shaped to hold the mask in a desired fitting relationship over the nose of the wearer and where the nose meets the cheek. The nose clip may be linear in shape when viewed from a plane projected onto the mask body when in its folded or partially folded condition. Alternatively, the nose clip can be M-shaped nose clip, an example of which is shown in U.S. Pat. No. 5,558,089 and Des. 412,573 to Castiglione. Other nose clips are described in U.S. patent application Ser. No. 12/238,737 (filed September 26, 12c08); U.S. Publications 2007-0044803A1 (filed August 25, 12c05); and 2007-0068529A1 (filed Sep. 27, 2005). As indicated above, the inventive dispenser can assist in placing a pliable nose clip in a curved shape ready for placement on the wearer's nose. The nose clip is in a substantially linear configuration while in the container. The constriction window is adapted to enable the outermost respirator to have the nose clip change from the substantially linear configuration to a curved configuration when pulled through the constriction window. The imparted curved configuration of the nose clip is concave relative to the mask body interior. Preferably, the curvature imparted by the dispenser onto the nose clip generally matches the curvature of a person's nose.

EXAMPLES

Mask Body Open Condition Test

A test has been devised to measure the degree to which a respirator opens or expands when dispensed in accordance with the present invention. The test measures an increase (or decrease) in the "projected area" of the respirator, as described below, as an indication of the respirator expanding (or contracting) when being passed through the constriction aperture.

The "projected area" of the respirator is measured by placing the mask body perimeter in contact with graph paper that has a ruling of 1 cm×1 cm squares. The outside perimeter of the mask body is traced on the graph paper using a pencil held in a normal or perpendicular position. The projected surface area is calculated by graphical methods to determine its effective area in square centimeters—see FIG. 5.

Example 1

Commercially available respirators, Model 9062 V-Flex™ from the 3M Company were obtained; these respirators were stacked in a nested, partially-folded condition in their original packaging. The projected area of 5 of these respirators (out of the package quantity of 25) was individually recorded as "Closed Configuration" in Table 1 below. The nose clip in an unbent condition had a baseline height of one mm and a width of 90 mm. These 5 respirators were then placed (in their original "nested and stacked in a partially-folded configuration) in the inventive dispenser described below.

Figure 5:
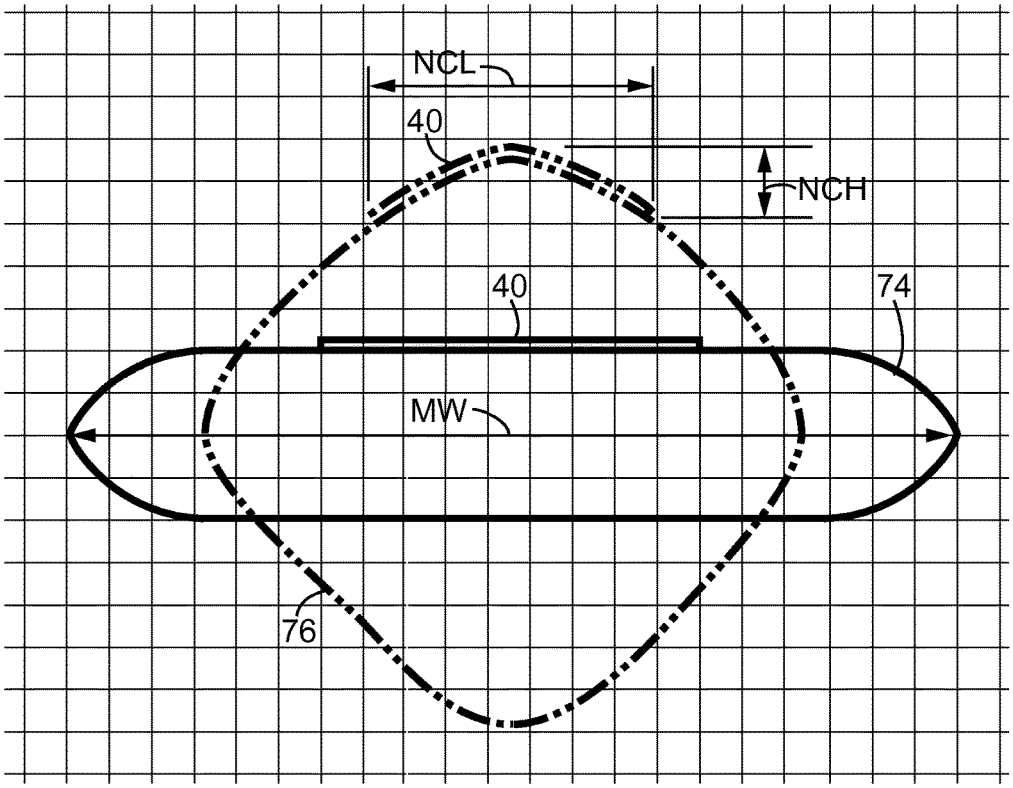
FIG. 5 is a profile view of a mask body perimeter 74, 76 projected onto a grid of squares in accordance with the Mask Body Open Condition Test set forth below.

The inventive dispenser was assembled using commercially available Zip Lock™ plastic bags that had a size 9 inches×12 inches and a 4 mil thick (0.1 mm), purchased from Collecting Warehouse™. A constriction aperture was manually cut into the plastic bag using a razor blade. The constriction aperture was located on the bag similar to the position shown in FIG. 1A. The size and shape of the constriction aperture was similar to the aperture 20 shown in FIG. 4 with the approximate dimensions: H=38 mm, R=45 mm, W=85 mm, L=24 mm, r=10 mm. Each of the 5 respirators was manually withdrawn from the dispenser by grasping the near side hem of the respirator and pulling the mask body through the constriction aperture. In doing so, the shape of the nose clip changed from a flat, linear shape to a u-shape, and the general projected area shape changed from a general narrow oblong 74 (closed configuration) to a general round shape 76 (opened configuration) as shown in FIG. 5. Applying the Mask Body Open Condition Test, the resulting measurements were individually recorded as "Opened Configuration" and "Nose Clip Bend Height and Length" and can be found in Table 1 below.

TABLE 1

| Sample No. | Closed Configuration ($cm^2$) | Opened Configuration ($cm^2$) | Nose Clip Bend Height "NCH" (mm) | Nose Clip Bend Length "NCL" (mm) |
|---|---|---|---|---|
| 1 | 86 | 119 | 29 | 64 |
| 2 | 77 | 118 | 26 | 62 |
| 3 | 85 | 121 | 32 | 65 |
| 4 | 82 | 121 | 30 | 64 |
| 5 | 85 | 124 | 28 | 67 |
| Total | 415 | 603 | 145 | 322 |
| Average | 83 | 121 | 29 | 64 |

The data set forth above shows that the projected area increased by approximately 46% when the respirator was withdrawn from the dispenser, demonstrating the dispenser's ability to take the respirator from a partially folded condition to an open condition. The original flat nose clip was significantly bent in a u-shape configuration, making the respirator more ready for donning. The nose clip height NCH went from a baseline value of 1 mm to 29 mm on average, while the nose clip length NCL decreased from a straight line original length of 90 mm to 64 mm on average.

What is claimed is:

1. A filtering face-piece respirator dispenser that comprises:

(a) a container that has a constriction aperture; and (b) a plurality of filtering face-piece respirators disposed within the container in a stacked, at least partially-folded condition, the plurality of stacked, at least partially-folded, filtering, face-piece respirators including an outermost respirator;

wherein the constriction aperture is adapted to allow for the outermost filtering face-piece respirator to be manually withdrawn from the container such that the outermost respirator goes from the at least partially-folded condition to an open condition and a mask body of the outermost respirator exhibits a projected surface area increase of at least 25% when tested under Mask Body Open Condition Test.

2. The filtering face-piece respirator dispenser of claim 1, wherein the plurality of respirators are disposed within the container in a nested arrangement.

3. The filtering face-piece respirator dispenser of claim 1, wherein the plurality of filtering face-piece respirators are not individually wrapped.

4. The filtering face-piece respirator dispenser of claim 1, wherein the constriction aperture is adapted to allow for the outermost flat filtering face-piece respirator to change from the at least partially-folded condition to a wearable condition as the outermost respirator passes through the constriction aperture.

5. The filtering face-piece respirator dispenser of claim 1, wherein the plurality of respirators each comprises a nose clip, the nose clip being in a substantially linear configuration while in the container, the constriction aperture being adapted to enable the outermost respirator to have the nose clip change from the substantially linear configuration to a curved configuration when pulled through the constriction aperture.

6. The filtering face-piece respirator dispenser of claim 5, wherein the curved configuration of the nose clip is concave relative to an interior of the mask body.

7. The filtering face-piece respirator dispenser of claim 1 containing a few filtering face-piece respirators in a nested arrangement.

8. The filtering face-piece respirator dispenser of claim 7 containing a multiple of filtering face-piece respirators in a nested arrangement.

9. The filtering face-piece respirator dispenser of claim 1, wherein the container comprises two or more panels joined together at edges, at least a front panel being transparent.

10. The filtering face-piece respirator dispenser of claim 9, wherein the two or more panels are flexible.

11. The filtering face-piece respirator dispenser of claim 10, wherein the constriction aperture is located centrally on the front panel near a bottom of the container.

12. The filtering face-piece respirator dispenser of claim 11, wherein the constriction aperture is adapted to enable a person removing the outermost respirator from the container to grasp a near side hem and pull the respirator through the aperture with a generally downward motion.

13. The filtering face-piece respirator dispenser of claim 1, wherein the constriction aperture is sized to have a width that is less than a width of the outermost respirator in the at least partially folded condition in a cross-wise dimension.

14. The filtering face-piece respirator dispenser of claim 1, wherein dispensing of the outermost respirator causes the mask body of the outermost respirator to exhibit a projected surface area increase of at least 35% when tested under Mask Body Open Condition Test.

15. The filtering face-piece respirator dispenser of claim 1, wherein dispensing of the outermost respirator causes the mask body of the outermost respirator to exhibit a projected surface area increase of at least 45% when tested under Mask Body Open Condition Test.

16. The filtering face-piece respirator dispenser of claim 14, wherein a frictional force between the constriction aperture and the mask body causes the mask body to be placed in the open condition.

17. The filtering face-piece respirator dispenser of claim 1, wherein the constriction aperture is adapted such that an action of removing the outermost respirator from the container causes a nose clip disposed on a mask body of the outermost respirator to be bent.

18. The filtering face-piece respirator dispenser of claim 1, wherein the container is a box that has a window on a front side of the box.

19. A filtering face-piece respirator dispenser that comprises:

(a) a container that has a constriction aperture; and (b) a plurality of filtering face-piece respirators disposed within the container in a stacked, at least partially-folded condition, each of the plurality of filtering face-piece respirators including a mask body that has a nose clip secured thereto in a nose region thereof, the plurality of stacked, at least partially-folded, filtering, face-piece respirators including an outermost respirator;

wherein the constriction aperture is adapted to allow for an outermost filtering face-piece respirator to be manually withdrawn from the container such that the outermost respirator goes from the at least partially-folded condition to an open condition, the nose clip becomes bent towards an in use condition, and the mask body of the outermost respirator exhibits a projected surface area increase of at least 25% when tested under Mask Body Open Condition Test.

20. A method of making a filtering face-piece respirator dispenser, which method comprises the steps of:

(a) providing a container that has a constriction aperture; and (b) placing a plurality of filtering face-piece respirators within the container in a stacked, at least partially-folded condition, the plurality of stacked, at least partially-folded, filtering face-piece respirators including an outermost respirator; wherein the outermost filtering face-piece respirator is oriented within the container relative to the aperture such that the outermost respirator can be manually withdrawn from the container to undergo a shape transformation from the at least partially-folded condition to an open condition and a mask body of the outermost respirator exhibits a projected surface area increase of at least 25% when tested under Mask Body Open Condition Test.

21. A filtering face-piece respirator dispenser that comprises:

(a) a container that has a constriction aperture; and (b) one or more filtering face-piece respirators disposed within the container;

wherein the constriction aperture is adapted to allow for the filtering face-piece respirator that is adjacent the constriction aperture to be manually withdrawn from the container such that the respirator goes from an at least partially-folded condition to an open condition and a mask body of the outermost respirator exhibits a projected surface area increase of at least 25% when tested under Mask Body Open Condition Test.

* * * * *